US006353049B1

(12) United States Patent
Doi et al.

(10) Patent No.: US 6,353,049 B1
(45) Date of Patent: Mar. 5, 2002

(54) ELASTIC POLYURETHANE FIBER AND PROCESS FOR PRODUCING THE SAME

(75) Inventors: Masanori Doi; Akihiko Yoshizato, both of Moriyama (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/367,346

(22) PCT Filed: Feb. 12, 1998

(86) PCT No.: PCT/JP98/00566

§ 371 Date: Aug. 12, 1999

§ 102(e) Date: Aug. 12, 1999

(87) PCT Pub. No.: WO98/36112

PCT Pub. Date: Aug. 20, 1998

(30) Foreign Application Priority Data

Feb. 13, 1997 (JP) ..... 9-029170

(51) Int. Cl.[7] ..... C08J 5/10; C08K 3/18; C08K 3/22; C08L 75/04

(52) U.S. Cl. ..... 524/432; 524/430; 524/431; 524/433

(58) Field of Search ..... 524/430, 431, 524/432, 433

(56) References Cited

U.S. PATENT DOCUMENTS

| | | | |
|---|---|---|---|
| 4,525,420 A | 6/1985 | Imai et al. | 428/372 |
| 5,447,969 A | 9/1995 | Kojima et al. | 523/200 |
| 5,626,960 A | 5/1997 | Carney | 428/372 |

FOREIGN PATENT DOCUMENTS

| | | |
|---|---|---|
| CA | 2221073 | 5/1998 |
| EP | 0 489 395 A1 | 6/1992 |
| GB | 2 080 349 | 2/1982 |
| JP | 60-43444 | 9/1985 |
| JP | 61-35283 | 8/1986 |
| JP | 3-292364 | 12/1991 |
| JP | 4-323615 | 11/1992 |
| JP | 5-80717 | 4/1993 |
| JP | 5-271432 | 10/1993 |
| JP | 6-41802 | 2/1994 |
| JP | 6-81215 | 3/1994 |
| JP | 8-54605 | 2/1996 |
| JP | 9-73067 | 3/1997 |
| JP | 10-253943 | 9/1998 |
| WO | 97/09473 | 3/1997 |

OTHER PUBLICATIONS

"Synthesis of Hydrotalcite–Like Compounds and Their Physico–Chemical Properties" *Reactivity of Solids,* 5, 219–228, 1988.*

* cited by examiner

*Primary Examiner*—Samuel A. Acquah
*Assistant Examiner*—U. K. Rajguru
(74) *Attorney, Agent, or Firm*—Finnegan, Henderson, Farabow, Garrett & Dunner, L.L.P.

(57) ABSTRACT

An elastic polyurethane fiber comprising, based on the fiber weight, from 0.5 to 10% by weight of composite oxide particles containing aluminium and at least one combination of zinc and magnesium selected from the group consisting of combinations of zinc and magnesium in respective specific ratios. The elastic polyurethane fiber has excellent chlorine resistance, and is suitable for swimwear for use in swimming pools. The elastic fiber can be obtained by spinning a polyurethane spinning dope containing, based on the polyurethane, from 0.5 to 10% by weight of the composite oxide particles. Filter clogging and yarn breakage caused by secondary agglomeration of the composite oxide particles are extremely decreased, and stabilized spinning can be conducted over a long period of time.

7 Claims, 4 Drawing Sheets

ELASTIC POLYURETHANE FIBER AND PROCESS FOR PRODUCING THE SAME

TECHNICAL FIELD

The present invention relates to an elastic polyurethane fiber, and a process for producing the same. The present invention relates, in more detail, to an elastic polyurethane fiber which hardly deteriorates in various chlorinated water environments and, particularly, which hardly deteriorates when used as swimwear in a swimming pool containing germicidal chlorine, and a process for stably producing the fiber.

BACKGROUND ART

An elastic polyurethane fiber obtained from an aromatic diisocyanate, a polyalkylene glycol and a polyfunctional hydrogen-containing compound has a high rubber elasticity, and is excellent in mechanical properties such as tensile stress and resilience, and thermal properties. Accordingly, the elastic polyurethane fiber as a stretchable functional fiber material has been widely used for applications requiring stretchability such as swimwear, foundation garments, stockings and sportswear.

However, when clothing products in which an elastic polyurethane fiber is used are repeatedly washed by immersing them in a chlorine bleaching agent over a long period of time, the elastic polyurethane fiber is known to lose its elastic function.

When swimwear in which an elastic polyurethane fiber is used is repeatedly exposed to a germicidal chlorine in water solution having an active chlorine concentration of from 0.5 to 3 ppm in, for example, a swimming pool, the elastic function thereof is significantly impaired or yarn breakage takes place during spinning. In particular, for swimwear comprising a polyamide fiber and an elastic polyurethane fiber, discoloration and fading of the fixed dye occur.

In order to improve the chlorine resistance of an elastic polyurethane fiber, a polyester-based elastic polyurethane fiber prepared by using an aliphatic polyester diol as a starting material has been employed. However, its chlorine resistance has been insufficient. Moreover, since an aliphatic polyester has a high biological activity, the polyester-based polyurethane has a disadvantage of being likely to be attacked by fungi. The polyester-based polyurethane therefore has the problem that the swimwear lowers its elastic function during its use or storage, and yarn breakage tends to take place. Although an elastic polyether-based polyurethane fiber prepared by using as a starting material a polyether diol having extremely low biological activity is not degraded by fungi, it has the problem that its chlorine resistance is still poorer than the polyester-based polyurethane.

Additives for improving deterioration of the elastic polyether-based polyurethane fiber caused by chlorine have been proposed. For example, Japanese Examined Patent Publication (Kokoku) No. 60-43444 discloses zinc oxide; Japanese Examined Patent Publication (Kokoku) No. 61-35283 discloses magnesium oxide, aluminium oxide, etc.; Japanese Unexamined Patent Publication (Kokai) No. 6-81215 discloses solid solution of magnesium oxide and zinc oxide.

The effects of magnesium oxide and aluminium oxide on the prevention of deterioration caused by chlorine which are disclosed in Japanese Examined Patent Publication (Kokoku) No. 61-35283 are not significant compared with comparative examples as shown in Table 1 on page 4 of the Patent Gazette. Zinc oxide disclosed in Japanese Examined Patent Publication (Kokoku) No. 60-43444 has the problem that the elastic polyether-based polyurethane fiber markedly lower its chlorine resistance because the zinc oxide component is eluted from the fiber during dyeing in an acid condition (pH 3 to 6) and the retained ZnO content in the fiber significantly decreases. The solid solution of magnesium oxide and zinc oxide disclosed in Japanese Unexamined Patent Publication (Kokai) No. 6-81215 produces little effect, similarly to zinc oxide. Although Japanese Unexamined Patent Publication (Kokai) No. 3-292364 discloses a polyurethane composition the chlorine resistance of which is improved by using hydrotalcite such as $Mg_{4.5}Al_2(OH)_{13}(CO_3).3.5H_2O$, the improvement does not reach a satisfactory level.

For swimwear comprising an elastic polyurethane fiber and a polyamide fiber, in order to prevent discoloration and fading of dye used in the swimwear with chlorine contained in the water of a pool, the swimwear is subjected to dye-fixation treatment with a tannin solution after dyeing. When the elastic polyurethane fiber containing magnesium oxide or a solid solution of magnesium oxide and zinc oxide is subjected to dye-fixation treatment with a tannin solution (pH 3 to 4.5) after dyeing, these additives are eluted therefrom, whereby the chlorine resistance thereof is further lowered.

When these additives are added to a polyurethane spinning dope or a molten polyurethane during the production of an elastic polyurethane fiber, secondary agglomeration takes place, whereby clogging of the spinning filter or yarn breakage during spinning is increased. ZnO having a particle size of 0.1 to 1 $\mu$m is used in Japanese Examined Patent Publication (Kokoku) No. 60-43444; MgO having a particle size of 5 $\mu$m or less is used in Japanese Examined Patent Publication (Kokoku) No. 61-35283; solid solution of MgO and ZnO having a particle size of 0.05 to 3 $\mu$n is used in Japanese Unexamined Patent Publication (Kokai) No. 6-81215. Japanese Unexamined Patent Publication (Kokai) No. 3-292364 discloses a method for preventing secondary agglomeration by coating the surface of hydrotalcite (for example, $Mg_{4.5}Al_2(OH)_{13}(CO_3).3.5H_2O$) with fatty acid. However, none of the inventions can achieve a satisfactory improvement.

An object of the present invention is to provide an elastic polyurethane fiber having excellent chlorine resistance over a long period of time after dyeing under an acidic dyeing condition (pH 3 to 6) or after dye-fixation treatment with a tannin solution (pH 3 to 4.5) subsequently to dyeing, and a process for stably producing the same.

DISCLOSURE OF THE INVENTION

As a result of intensively carrying out investigations to solve these problems, the present inventors have found that an elastic polyurethane fiber comprising, based on the polyurethane, 0.5 to 10% by weight of composite oxide particles which comprise bivalent metal $M^{2+}$ wherein $M^{2+}$ is at least one metal selected from the group consisting of zinc and magnesium, and aluminium, and in which the molecular ratio of the bivalent metal $M^{2+}$ to aluminium is from 1 to 5 not only has still more excellent chlorine resistance than the elastic polyurethane fiber to which the additives mentioned above are added, but also shows, astonishingly, that filter clogging and yarn breakage during spinning caused by secondary agglomeration of the composite oxide particles in the spinning dope are extremely reduced. They have therefore found that the elastic polyurethane fiber can be stably produced.

The composite oxide particles of the present invention can be produced by known methods. For example, the following methods are included therein: a method comprising melting a mixture containing zinc oxide, magnesium carbonate, aluminium hydroxide, etc. at 1,600° C., annealing the molten mixture at 600° C., and cooling the annealed material slowly (Journal of Non-Crystalline Solids, 129, 174–182 (1991); a method comprising firing a mixture containing zinc oxide and γ-aluminium hydroxide at 900 to 1,000° C. (Journal of Japan Ceramic Society, 91 (6), 281–289 (1983)); a method comprising adding lithium chloride, ethyl silicate and hydrochloric acid to an aqueous solution of magnesium nitrate and aluminium oxide to effect reactions, and firing the reaction products at 700 to 1,300° C. (Chemistry Express, a (11), 885 to 888 (1990)); a method comprising spraying a solution of magnesium nitrate and aluminium nitrate in ethanol into a tube heated at temperatures from 740 to 1,030° C. to effect reactions (Ceramics International, 8, 17–21 (1982)). Composite oxides having various compositions and morphologies can be produced by suitably setting starting materials, a composition ratio of the starting materials, a reaction (firing) time, reaction (firing) temperatures, etc. Particularly preferred production examples are methods for firing specific composite compounds as disclosed in Japanese Examined Patent Publications (Kokoku) Nos. 51-37640 and 51-20997.

BEST MODE FOR CARRYING OUT THE INVENTION

Figure 1:
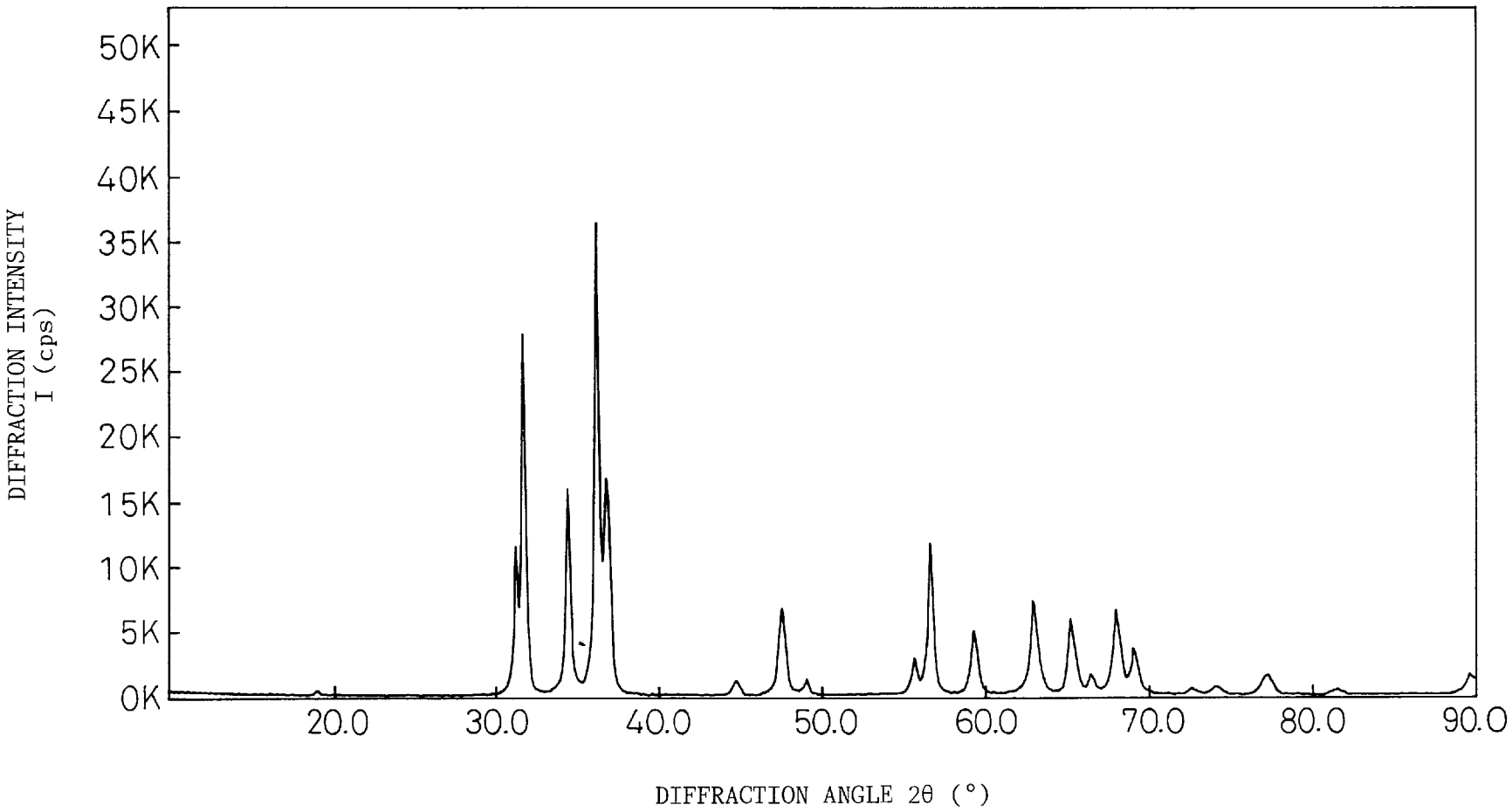
FIG. 1 is a powder X-ray diffraction pattern diagram of 3 $ZnO.ZnAl_2O_4$ (fired at 900° C.).

The composite compound of the present invention is a precursor of a composite oxide, and signifies a compound which is capable of being oxidized in the course of firing the composite compound to form the composite oxide. Typical examples of the composite compound are hydrotalcite compounds known as composite hydroxides.

The present invention will be explained below by taking as examples composite oxide particles obtained by firing hydrotalcite compounds as composite compounds. However, the present invention is not restricted to the examples.

One example of a hydrotalcite compound used in the present invention is represented by the formula (1):

$$M^{2+}{}_xAl_2(OH)_{2x+6-nz}(A^{n-})_z.mH_2O \quad (1)$$

wherein $M^{2+}$ is Zn or Mg, $A^{n-}$ is an n-valent anion such as $OH^-$, $F^-$, $Cl^-$, $Br^-$, $NO_3^-$, $CO_3^{2-}$, $SO_4^{2-}$, $Fe(CN)_6^{3-}$, $CH_3COO^-$, an oxalate ion and a salicylate ion, n is the valency of the anion, $x>0$, $0<z<2$, and $m>0$.

The composite oxide particles in the present invention are obtained by firing the hydrotalcite mentioned above. Zinc is preferred because zinc has chlorine resistance higher than that of magnesium and imparts thereto a low degree of swelling for chlorine water. The composite oxide of the present invention can be produced by the production methods disclosed in Japanese Examined Patent Publication (Kokoku) Nos. 51-37640 and 51-20997.

The composite oxides obtained by firing hydrotalcite compounds in which $M^{2+}$ is zinc will be explained as appropriate examples.

Preferred examples of the hydrotalcites containing zinc and aluminium include:

$Zn_3Al_2(OH)_{10}(CO_3).2H_2O$, $Zn_4Al_2(OH)_{12}(CO_3).3H_2O$, $Zn_5Al_2(OH)_{14}(CO_3).4H_2O$, and $Zn_6Al_2(OH)_{16}(CO_3).5H_2O$ The firing temperatures of the hydrotalcites are from 300 to 1,200° C. When the firing temperature is less than 300° C., a satisfactory oxide-structure is not formed, the hydrotalcites which are the starting materials remain and the chlorine resistance becomes insufficient. When the firing temperature exceeds 1,200° C., sintering begins to take place, coarse particles are formed and filter clogging and yarn breakage during spinning tend to take place. The most preferred firing temperature range is from 700 to 1,200° C. When the firing temperature is 700° C. or above, a spinel structure of $ZnAl_2O_4$ is formed, the activity is weakened and the fired product tends to be easily dispersed in the spinning dope. A firing temperature of 300° C. or above and less than 700° C. is in a region for forming a solid solution of zinc oxide and aluminium oxide. The resultant fired product shows a slightly higher activity than the product obtained by firing in a firing temperature region of 700 to 1,200° C., and tends to show secondary agglomeration. However, since aluminium is partially substituted into the zinc crystal lattice, strong secondary agglomeration does not take place as compared with zinc oxide and magnesium oxide. Accordingly, a spinning dope containing the composite oxide obtained by firing in this temperature region can be more stably spun than one containing zinc oxide and magnesium oxide.

Sato et al. (Reactivity of Solids, 5, 219–228 (1988)) have reported that firing a hydrotalcite compound forms solid solution or a spinel structure with metal oxides (eutectoid) depending on the firing temperature. The present inventors have elucidated for the first time that application of the composite oxide thus obtained to an elastic polyurethane fiber significantly improves its chlorine resistance, and that an elastic polyurethane fiber can be stably produced over a long period of time.

In the present invention the composite oxide obtained by firing a hydrotalcite at temperatures from 300 to 700° C. is mainly composed of a solid solution, and can be represented by the general formula (2):

$$Zn_{1-y}Al_{y-\square}O \quad (2)$$

wherein □ represents cationic lattice defects, and $0<y<1$.

The composite oxide obtained by firing at temperatures of 700° C. or greater is an eutectoid of zinc oxide and zinc aluminate, and is represented by the general formula (3):

$$(x-1)ZnO.ZnAl_2O_4 \quad (3)$$

wherein x is a positive numeral represented by $x \geqq 2$.

There is no drastic change of the crystal structure of the composite oxide of the formula (2) to that of the composite oxide of the formula (3) at the temperature boundary of 700° C.; the structure of the formula (2) and that of the formula (3) coexist in the temperature region of 650 to 750° C.

The molar ratio of zinc to aluminium (zinc/aluminium) is preferably from 1 to 5, more preferably from 2 to 3. When the Zn/Al ratio is less than 1, the effect of chlorine resistance is not sufficient. When the zinc/aluminium ratio exceeds 5, secondary agglomeration takes place because the activity of zinc becomes excessively strong, and the filter clogging and yarn breakage during spinning increase.

Although formation of the composite oxides has been explained above by taking zinc as a bivalent metal $M^{2+}$, the explanation is similar even when $M^{2+}$ is magnesium or a mixture of zinc and magnesium.

Appropriate examples of the composite oxide in the present invention are:

$2ZnO.ZnAl_2O_4$, $3ZnO.ZnAl_2O_4$, $4ZnO.ZnAl_2O_4$, and $5ZnO.ZnAl_2O_4$

Figure 2:
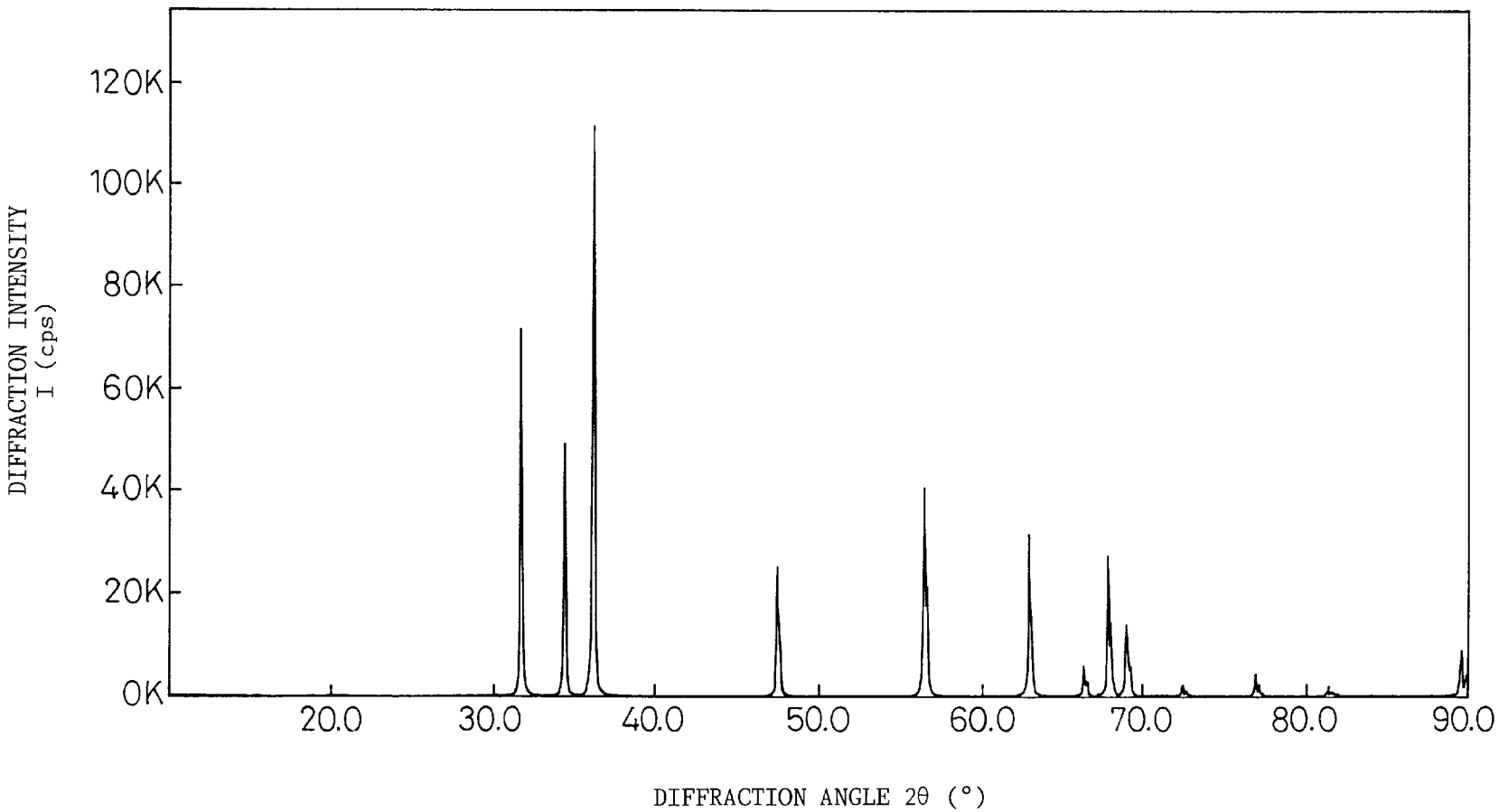
FIG. 2 is a powder X-ray diffraction pattern diagram of zinc oxide.

When the powder X-ray diffraction spectrum of a composite oxide of the present invention is observed, it is seen that the composite oxide has the specific crystal structure pattern having a spinel structure of $ZnAl_2O_4$ in the zinc oxide crystals, and the crystal pattern differs from that of zinc oxide. FIG. 1 shows a powder X-ray diffraction pattern of the composite oxide $3ZnO.ZnAl_2O_4$ (product obtained by firing at 900° C.). FIG. 2 shows a powder X-ray diffraction pattern of zinc oxide (JIS special). Cu—$K_\alpha$ radiation and a Ni filter were used in the measurement of the powder X-ray diffraction.

When the purity of zinc oxide in a composite oxide of the present invention is determined by potassium ferrocyanide titration (JIS-K1410 4.2 (2) internal indicator method), the purity of ZnO in, for example, $3ZnO.ZnAl_2O_4$ (product obtained by firing at 900° C.) as represented by the formula (3) is 57.0%, which approximately agrees with the theoretical value (57.1%).

The solid solution represented by the formula (2) forms a structure in which aluminium oxide is dissolved in zinc oxide, namely, a structure in which aluminium is partially substituted into the sites of Zn in the zinc oxide crystals.

The elastic polyurethane fiber containing composite oxide particles in the present invention shows extremely decreased elution of the additives under acidic (pH 3 to 6) dyeing conditions or under dye-fixation treatment conditions with a tannin solution (pH 3 to 4.5) as compared with an elastic polyurethane fiber containing zinc oxide or solid solution of magnesium oxide and zinc oxide; moreover, discoloration of the elastic polyurethane fiber and the swelling amount thereof in chlorine water are extremely slight. Furthermore, the elastic polyurethane fiber in the present invention exhibits an excellent effect on chlorine resistance over a long period of time even when it is exposed to a chlorine bleaching agent, germicidal chlorine in a swimming pool, or the like.

The composite oxide of the present invention exhibits such excellent effects for the reasons explained below. When the composite compound is a hydrotalcite compound, firing the hydrotalcite compound forms a solid solution of zinc oxide and aluminium oxide (hereinafter referred to as (Zn, Al)O solid solution) or makes $ZnAl_2O_4$ fine eutectic crystalline precipitate as eutectoid on the surface of zinc oxide. These substances are thought to play a protective role in the strongly acidic dyeing treatment or treatment with a tannin solution. Aluminium partially substituted for zinc and $ZnAl_2O_4$ as eutectoid suppress a high agglomeration energy of zinc oxide, and exhibit an excellent effect of preventing secondary agglomeration; as a result, the composite oxide is thought to suppress filter clogging and yarn breakage, and the elastic polyurethane fiber can be produced stably.

Figure 3:
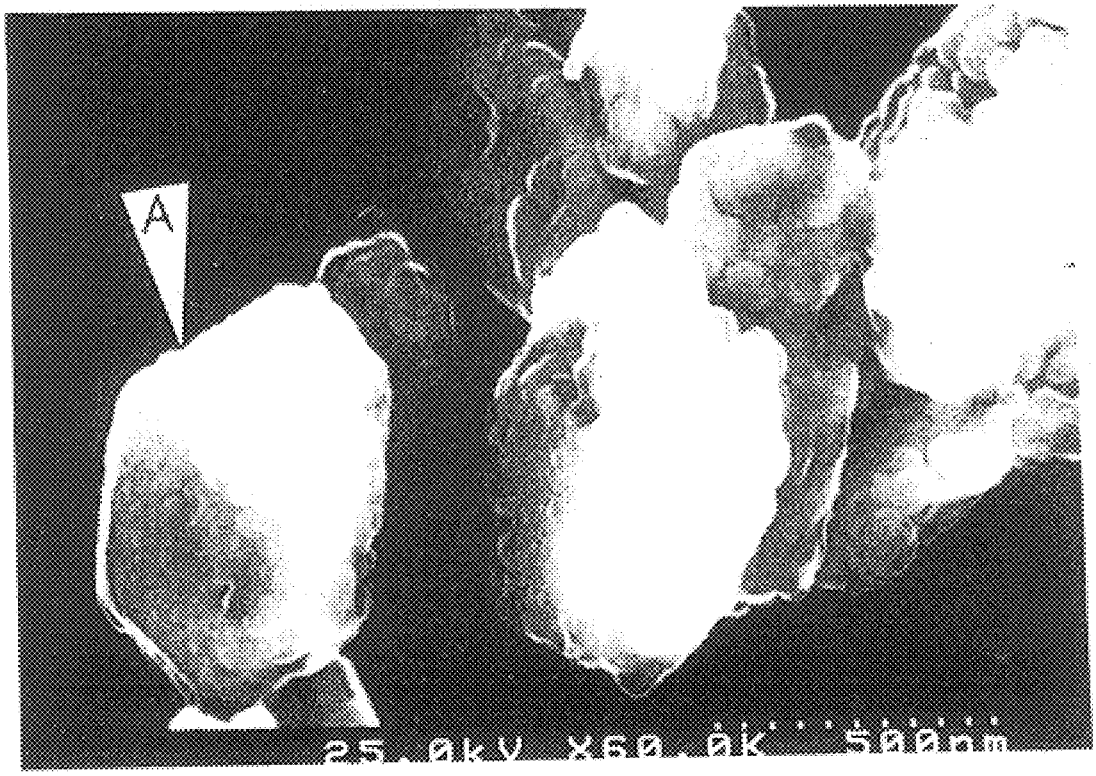
FIG. 3 is an electron microscopic photograph of 3 $ZnO.ZnAl_2O_4$ (fired at 900° C.).
Figure 4:
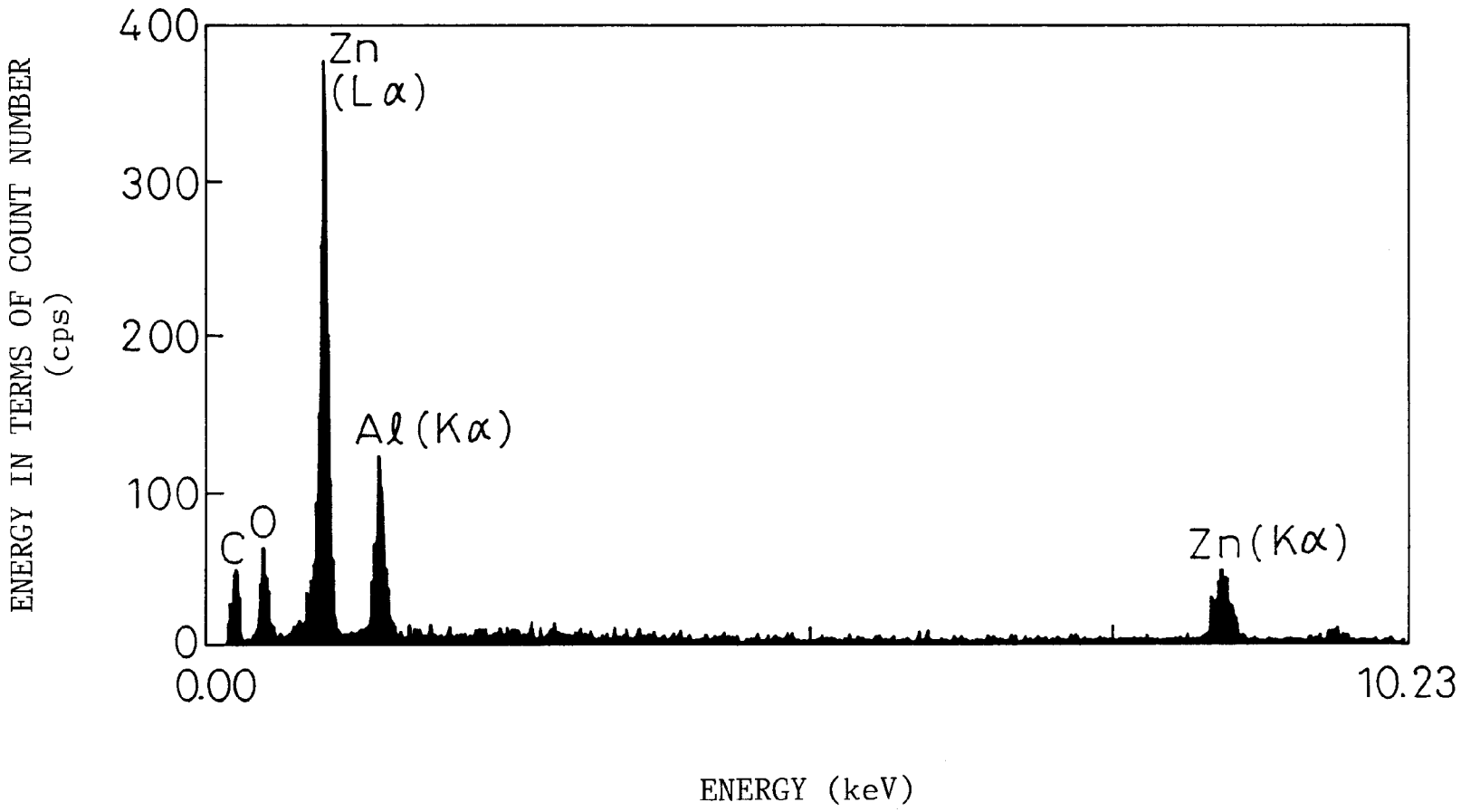
FIG. 4 is an elementary analysis chart of the crystalline grain A in FIG. 3.

FIG. 3 is an example of the electron microscopic photographs of the composite oxide $3\ ZnO.ZnAl_2O_4$ obtained by firing $Zn_4Al_2(OH)_{12}(CO_3).3H_2O$ at 900° C. It is evident from the photograph that $ZnAl_2O_4$ crystals are of eutectoid on the surface of hexagonal plate-like crystals of zinc oxide. FIG. 4 is a chart showing the elemental analysis of the crystalline grain A in the photograph of FIG. 3, and zinc and aluminium are detected. FIGS. 3 and 4 are a photograph and a chart, respectively, obtained by observing and conducting analysis using an electron microscope (trade name of S-4100, manufactured by Hitachi Ltd.) equipped with an X-ray microanalyzer (trade name of EMAX-2770, manufactured by Horiba Ltd.) (acceleration voltage of 25 kV, magnification of 6,000, carbon deposition).

The present invention is characterized by that the composite oxide particles mentioned above are contained in an amount of 0.5 to 10% by weight based on the elastic polyurethane fiber. The composite oxide particles show an insufficient effect of chlorine resistance when the content is less than 0.5% by weight, and they not only exert adverse effects on the physical properties of the fiber but also increase yarn breakage during spinning when the content exceeds 10% by weight. A more preferred content is from 2 to 8% by weight.

The composite oxide in the present invention is more effective for the chlorine resistance when it has a smaller particle size, and the production stability is increased because filter clogging and yarn breakage during spinning become extremely rare. The average particle size is preferably 5 $\mu$m or less. When the average particle size exceeds 5 $\mu$m, filter clogging and yarn breakage tend to take place. It is more preferred to make the average particle size 1 $\mu$m or less by wet grinding the composite oxide in a polar solvent such as dimethylformamide or dimethylacetamide.

For swimwear made up of knitting of an elastic polyurethane yarn and a polyamide fiber, in order to prevent discoloration and fading caused by chlorine after dyeing, the swimwear is usually treated with a tannin solution to fix the dye on the fiber after dyeing. The tannin solution acts to dissolve and remove metal oxide used as an anti-chlorine agent of the elastic polyurethane fiber from the fiber. In order to prevent such action, the surface of the composite oxide particles of the present invention are preferably treated with such substances disclosed in Japanese Unexamined Patent Publication (Kokai) No. 3-292364 as fatty acids, silane coupling agents, esters of fatty acid, phosphoric esters, styrene/maleic anhydride copolymers and their derivatives and titanate coupling agents, or a mixture of these substances.

Such a surface treating agent is allowed to adhere to the composite oxide particles preferably in an amount of 0.1% or more by weight based on the composite oxide. Sufficient effects cannot be obtained when the amount is less than 0.1% by weight, and no further improved effects can be obtained substantially when the amount exceeds 10% by weight.

Fatty acids used in the surface treatment are mono- or dicarboxylic acids having a linear or branched alkyl group of 10 to 30 carbon atoms. Examples of the fatty acids include capric acid, lauric acid, myristic acid, palmitic acid, stearic acid and behenic acid. Esters of fatty acid used in the surface treatment are esters of the fatty acids as mentioned above with mono- or polyvalent alcohols having a linear or branched alkyl group of 1 to 30 carbon atoms. Examples of the fatty acid esters include glyceryl monostearate, stearyl oleate and lauryl oleate. Fatty acids are more effective than esters of fatty acid. Linear or branched fatty acids having from 10 to 20 carbon atoms are particularly preferred, and stearic acid is most preferred.

Phosphoric esters may be either of monoester_ type, or of diester type or of a mixture of both types. However, phosphoric esters each having a linear or branched alkyl group, which belong to one ester, of 4 to 30 carbon atoms are preferred. Examples of the phosphoric esters include butyl acid phosphate, 2-ethylhexyl acid phosphate, lauryl acid phosphate, tridecyl acid phosphate, stearyl acid phosphate, di-2-ethylhexyl phosphate and oleyl acid phosphate. Phosphoric acid esters each having a linear or branched alkyl group, which belongs to one ester, of 8 to 20 carbon atoms are more preferred; stearyl acid phosphate is most preferred.

Appropriate examples of the styrene/maleic anhydride copolymer include a copolymer of the formula (4)-1:

(4) - 1

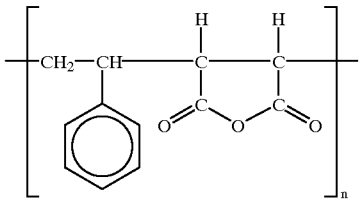

wherein n is from 6 to 8.

The styrene portion in the formula (4)-1 may also become polystyrene to form a copolymer with the maleic anhydride, or n therein may be in a range from 3 to 20.

Examples of the styrene/maleic anhydride copolymer derivatives include esterified derivatives (esterification of the maleic anhydride portion with an alcohol), sulfonated derivatives (sulfonation of the styrene portion), imide derivatives (imide formation of the maleic anhydride portion with an amine) and copolymers with an unsaturated alcohol. Of various derivatives, esterified derivatives are most preferred, and an alcohol used for esterification desirably has a linear or branched alkyl group of 3 to 20 carbon atoms. One example of the esterified derivatives is shown by the formula (4)-2:

(4)-2

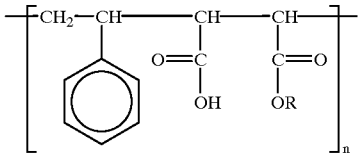

wherein R is a 1/1 mixture of an isopropyl group and an n-hexyl group, and n is 6 to 8.

One example of the copolymers with an unsaturated alcohol is a graft polymer of a styrene/maleic anhydride/allyl alcohol copolymer with polyoxyalkylene glycol shown by the formula (4)-3:

(4)-3

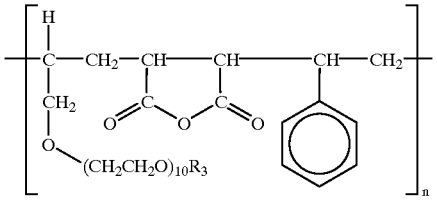

wherein $R_3$ is a n-butyl group, and n is from 20 to 40.

Examples of the silane coupling agent include γ-glycidoxypropyltrimethoxysilane, γ-mercaptopropyltrimethoxysilane and N-β-(aminoethyl)-γ-aminopropyltrimethoxy-silane. Examples of the titanate coupling agent include isopropyltriisostearoyl titanate, isopropyltris(dioctyl pyrophosphate) titanate and isopropyltridecylbenzene-sulfonyl titanate.

Various surface treating agents as mentioned above are used singly or in a mixture of two or more of them.

Of these surface treating agents, it is desirable to use fatty acids, phosphoric esters, styrene/maleic anhydride copolymers and esterified products of styrene/maleic anhydride copolymers.

Examples of the method for allowing a surface treating agent to adhere to the composite oxide particles in the present invention include: (1) a method comprising directly heating the composite oxide and the surface treating agent; (2) a method comprising directly spraying or mixing the composite oxide with the surface treating agent dissolved in an organic solvent, and removing the organic solvent; (3) a method comprising dispersing the composite oxide in a solvent for the polyurethane in which the surface treating agent is dissolved; (4) a method comprising adding the surface treating agent to a polyurethane solution containing the composite oxide, and mixing the surface treating agent with the solution; (5) a method comprising dissolving or dispersing the surface treating agent in finish oil, and allowing the surface treating agent to adhere to the fiber together with the finish oil during spinning and winding an elastic polyurethane fiber; (6) a method comprising treating a plaited knitting composed of an elastic polyurethane fiber containing the composite oxide and a polyamide fiber with a solution in which the surface treating agent is dissolved or dispersed; and (7) other various known methods. The methods by coating (1) to (4) exemplified above and capable of efficiently allowing the surface treating agent to directly adhere to all the composite oxide particles are preferred. The methods (2) to (3) are more preferred.

Specific examples of allowing the surface treating agent to adhere to the composite oxide particles by coating include the following methods: a method comprising placing the composite oxide in the present invention and 2% by weight based on the composite oxide of stearic acid in a Henschel mixer, heating, and stirring them; a method comprising placing the composite oxide and 4% by weight based on the composite oxide of lauric acid dissolved in methanol in a conical drier, mixing them, and removing methanol; and a method comprising dispersing by a homomixer the composite oxide and 1% by weight based on the composite oxide of an esterified product of a styrene/maleic anhydride copolymer represented by the formula (4)-2 is directly dissolved in dimethylacetamide, a solvent for the polyurethane.

The procedure of allowing these surface treating agents to adhere to the composite oxide surface at the stage of a spinning dope prior to spinning the elastic polyurethane fiber has the effect of inhibiting secondary agglomeration of the composite oxide particles in the spinning dope in addition to the effect of further improving the durability of the fiber to chlorine subsequent to tannin treatment. Accordingly, the procedure also has the effects of decreasing filter clogging of the spinning dope and diminishing yarn breakage during spinning.

The polyurethane used in the present invention is produced from, for example, a polymer glycol having hydroxyl groups at both molecular ends and a number average molecular weight of 600 to 5,000, an aromatic diisocyanate and a chain extender having polyfunctional active hydrogen atoms. Examples of the polymer glycol include various diols each composed of a substantially linear homo- or copolymer such as polyester diols, polyether diols, polyester amide diols, polyacryl diols, polythioester diols, polythioether diols and polycarbonate diols, or a mixture of these substances or a copolymer thereof and the like. Examples of the aromatic diisocyanate include 4,4'-diphenylmethane diisocyanate and 2,4-tolylene diisocyanate and the like. Examples of the chain extender having polyfunctional active hydrogen atoms include 1,4-butanediol, ethylene glycol, ethylenediamine, 1,2-propylenediamine, 1,3-diaminocyclohexane, m-xylylenediamine, hydrazine, piperazine, dihydrazide and water, or material containing a mixture of these substances and the like as its major component. Known techniques for polyurethane-forming reactions can be applied to the preparation of the polyurethane. For example, a polyalkylene glycol and an aromatic diisocyanate are reacted under the condition that the aromatic diisocyanate is present in an excessive amount, and the reaction products are dissolved in a polar solvent such as dimethylacetamide to give a solution of a polyurethane prepolymer. The prepolymer is subsequently reacted with a chain extender to give the polyurethane.

The composite oxide in the present invention is usually added to the solution of the polyurethane. However, the composite oxide may also be added to the starting materials of the polyurethane in advance, or it may also be added during the reaction of polyurethane prepolymer or the reaction of chain extension.

Such compounds other than the composite oxides in the present invention usually used for the elastic polyurethane fiber as ultraviolet ray absorbers, antioxidants, stabilizers, gas-resistant stabilizers, coloring agents, delustering or matting agents and fillers may be added to the solution of polyurethane.

The solution of polyurethane thus obtained can be formed into a fibrous shape by a known procedure such as dry spinning or wet spinning to give an elastic polyurethane fiber.

The following substances may be applied to the elastic polyurethane fiber: polydimethylsiloxanes, polyester-modified silicones, polyether-modified silicones, amino-modified silicones, a mineral oil, fine mineral particles such as silica, colloidal alumina and talc and the like, a powder of metal salts of higher fatty acids such as Mg stearate and calcium stearate and the like, and a finish oil, which is solid wax, etc. at room temperature, such as higher aliphatic carboxylic acids, higher aliphatic alcohols, paraffin and polyethylene and the like. These substances may be used singly or in an optional combination thereof.

The elastic polyurethane fiber of the present invention may be used as a bare spandex yarn without further processing, or it may be used as a covered elastic fiber by covering it with another known fiber such as a polyamide fiber, a polyester fiber, wool, an acrylic fiber, cotton and a regenerated fiber.

The elastic polyurethane fiber of the present invention can be appropriately used in particular for racing swimwear used in swimming pools. However, the application is not restricted thereto. It can also be used for common swimwear, tights, pantihose, foundation garments, socks, rib tops, corsets, bandages, various sportswear, and the like.

Various pretreatments and measurement methods for evaluating the properties of the elastic polyurethane fiber will be explained below.

[1] Measurement of Breaking Strength

The tensile breaking strength of a test yarn having a sample length of 5 cm is measured at a tensile rate of 50 cm/min at 20° C. and a relative humidity of 65% using a tensile testing machine (trade name of UTM-III 100 Type, manufactured by Orientech K.K.).

[2] Measurement of Available Chlorine Concentration

A chlorinated water sample in an amount of 25 ml is weighed and placed in a 100-ml Erlenmeyer flask, and 2 g of potassium iodide having been dried is added thereto and mixed therewith by shaking the flask. The mixture is titrated with a 1/100 N sodium thiosulfate solution and; a solution of starch is added thereto at the time when the solution turns pale yellow from orange. The resultant solution is titrated with the 1/100 N sodium thiosulfate solution until a blue color resulting from an iodo-starch reaction disappears. Separately, 25 ml of ion-exchanged water is sampled, and titrated in the same manner as explained above to give a blank titration amount. The available chlorine concentration H is obtained from the formula (5):

$$H=(0.003545(Vs-Vb)\times f)/Ws\times 10^6 \quad (5)$$

wherein H is an available chlorine concentration (ppm), Vs is a titration amount (ml) of the 1/100 N sodium thiosulfate solution when the chlorinated water is titrated, Vb is a titration amount (ml) of the 1/100 N sodium thiosulfate solution when the ion exchange-purified water is titrated, f is a titer of the 1/100 N sodium thiosulfate solution, and Ws is a weight (g) of the chlorinated water.

[3] Dyeing

A dye (Irgalan Black BGL 200 manufactured by Bayer Ltd.) in an amount of 2% by weight based on the amount of a sample (fiber to be dyed) and 12 g of ammonium sulfate are dissolved in 9 liters of ion-exchanged water, and the pH of the dyeing solution is adjusted to 4 with acetic acid. The sample, while being elongated by 50%, and subsequently is heat set at 180° C. for 1 minute, and dyed at 95° C. for 40 minutes. The sample is then washed with flowing service water for 10 minutes, and air dried at 20° C. for a whole day.

[4] Tannin Treatment Solution

To 6 liters of ion-exchanged water are added 4.5 g of tannic acid (trade name of Hi-fix SLA, manufactured by Dainippon Pharmaceutical Co., Ltd.) and 2.7 g of acetic acid. The sample having been dyed above is placed in the resultant treating solution at 25° C. while being elongated by 50%. The treating solution is then heated to 50° C., and the sample is immersed therein for 30 minutes, followed by washing the sample with flowing service water for 10 minutes. The test yarn having been treated with the tannin solution is air dried at 20° C. for a whole day.

[5] Evaluation of Chlorine Resistance

A solution of sodium hypochlorite (manufactured by Sasaki Yakuhin K.K.) is diluted with ion exchange-purified water so that the available chlorine concentration becomes 3 ppm. The pH of the solution is adjusted to 7 with a buffer solution of citric acid and sodium hydrogenphosphate. A sample treated with a tannin solution is immersed in the solution at 30° C. while the sample is being elongated by 50%. Part of the sample is periodically taken every 8 hours (1 cycle). The breaking strength of the part is measured, and the tenacity retention ratio of tenacity ΔT is calculated according to the formula (6):

$$\Delta T=TS/TS_0\times 100 \quad (6)$$

wherein ΔT is a tenacity retention ratio (%), TS is a tenacity (g) subsequent to the treatment, and $TS_0$ is a tenacity (g) prior to the treatment, is determined.

The chlorine resistance is evaluated from the time ($\tau_{1/2}$) consumed until the tenacity retention ratio of tenacity lowers to 50%.

Larger $\tau_{1/2}$ (hr) signifies that the chlorine resistance is more excellent.

[6] Evaluation of Spinning Dope with regard to Filter Clogging

A polyurethane spinning dope is passed through a filter (10 μm, trade name of Naslon Filter, manufactured by Nippon Seisen Co., Ltd.) having a diameter of 10 mm at a constant flow rate of 3 l/hr, and from the dope supply pressures after 0.1 hr and 2 hr, and the filter clogging pressure rise rate ΔP is calculated by the formula (7):

$$\Delta P=(P_2-P_1)/P_1\times 100 \quad (7)$$

wherein $P_1$ is a dope supply pressure (kg/cm$^2$) after supplying the dope for 0.1 hr, and $P_2$ is a dope supply pressure (kg/cm$^2$) after supplying the dope for 2 hr, is determined.

Larger ΔP signifies that the filter clogging is more significant.

[7] Evaluation of Spinning Stability

A polyurethane spinning dope is passed through a filter (40 μm, trade name of Naslon Filter, manufactured by Nippon Seisen Co., Ltd.), and the dope is dry spun by extruding the dope through 5 orifices each having a diameter of 0.2 mm to form an elastic polyurethane fiber having 40 denier/5 filaments. The fiber is once wound at a winding rate of 300 m/min for 3 minutes; the winding rate is gradually increased, and the spinning stability is evaluated by a limit denier per single filament calculated from the formula (8):

$$\text{Limit single filament denier (d)}=40/5\times 300/X \quad (8)$$

wherein X is a winding rate (m/min) at the time when yarn breakage takes place within the spinning tube.

A smaller denier per filament (limit denier per single filament) signifies that the polyurethane is more excellent in spinning stability.

[8] Evaluation of Chlorine Resistance of 2-Way Tricot Fabric

A gray fabric is knitted under the following conditions using a bright fiber (manufactured by Mitsubishi Rayon Co., Ltd.) which is prepared from a cation-dyeable ester and has a fineness of 50 denier/17-filaments in the front and an elastic polyurethane fiber in the back: 28 gauges; a front runner of 172 cm; and a back runner of 75 cm. The gray fabric is then set at 190° C. for 1 minute, treated with a pH adjusted solution (pH 5) containing 1.7 g/l of acetic acid and 1.0 g/l of sodium sulfate at 95° C. for 60 minutes, and subsequently set at 180° C. for 1 minute to obtain a finished fabric.

The knitted fabric is repeatedly immersed in a swimming pool for 12 hours and air dried for 12 hours while being stretched in the weft direction by 80%. The available chlorine concentration is always adjusted to 2.5 ppm during the immersion for 12 hours. In addition, the knitted fabric is washed with service water having an available chlorine concentration of 0.3 ppm, and air-dried for 12 hours as mentioned above. When the knitted fabric is taken out from immersion for 12 hours, it is observed to confirm whether or not it has defects. The number of days until defects are generated in the fabric is defined to be chlorine-durable days of the knitted fabric. A knitted fabric having more chlorine-durable days has a higher chlorine resistance.

[9] Determination of Anti-Chlorine Agent in 2-Way Tricot Fabric

A 2-way tricot fabric in an amount of 1 g is incinerated on a platinum plate by heating it with a muffle electric furnace at 400° C. for 5 hours. The residue thus formed is dissolved in 30 ml of 35% hydrochloric acid, and filtered, thereby removing insoluble material. The concentration of Zn or Mg is determined by an inductively coupled emission spectrochemical apparatus (ICP, trade name of IRIS/AP type, manufactured by Nippon Jarrel Ash K.K.), and the amount F of an anti-chlorine agent (g/1 g of the 2-way tricot fabric) is determined. On the other hand, 5 g of a 2-way tricot fabric is immersed in 300 ml of dimethylacetamide, thereby dissolving the elastic polyurethane fiber in the knitted fabric. The knitted fabric after dissolution is dried at 70° C. for 15 hours. From the weight ratio of the knitted fabric subsequent to dissolution to that prior to dissolution, the blending ratio w (%) of the elastic polyurethane fiber in the 2-way tricot fabric is determined. The content E (%) of the anti-chlorine agent based on the solid component of the polyurethane is determined from the formula (9):

$$E\ (\%)=F/(W/100) \quad (9)$$

The present invention will be concretely explained by making reference to examples. However, the present invention is not restricted thereto.

EXAMPLE 1

Polytetramethylene ether glycol having an average molecular weight of 1,800 in an amount of 1,500 g was reacted with 312 g of 4,4'-diphenylmethane diisocyanate in a nitrogen gas stream at 60° C. for 90 minutes with stirring to give a polyurethane prepolymer having isocyanate groups at both molecular ends. The reaction products were cooled to room temperature, and 2700 g of dimethylacetamide was added thereto. The mixture was dissolved to give a solution of polyurethane prepolymer.

Ethylenediamine in an amount of 23.4 g and diethylamine in an amount of 3.7 g were dissolved in 1,570 g of dried dimethylacetamide, and the resultant solution was added to the prepolymer solution at room temperature to give a polyurethane solution having a viscosity of 2,200 P (30° C.).

To dimethylacetamide were added 1% by weight, based on the polyurethane solid component, of 4,4'-butylidenebis-(3-methyl-6-t-butylphenol), 0.5% by weight of 2-(2'-hydroxy-3'-t-butyl-5'-methylphenyl)-5-chlorobenzotriazole and 4% by weight of a composite oxide of 3 $ZnO.ZnAl_2O_4$ (product obtained by firing $Zn_4Al_2(OH)_{12}(CO_3).3H_2O$ at 900° C.) having an average particle size of 1 μm or less, and dispersed by a homomixer to give a 15 wt. % dispersion liquid, followed by mixing the dispersion liquid with the polyurethane solution.

The polymer solution was dry spun at a spinning rate of 550 m/min at a hot air temperature of 330° C. to give a fiber of 40 denier/4 filaments. The yarn was dyed, and treated with tannin, and the chlorine resistance of the yarn was evaluated.

EXAMPLE 2

The $3ZnO.ZnAl_2O_4$ particles in Example 1 were sprayed with a solution containing 30% by weight of stearic acid in ethanol with a Henschel mixer so that 1% by weight of stearic acid based on the particle weight was allowed to adhere to the particle surface, and dried in a safety oven at 100° C. An elastic polyurethane fiber was produced in the same manner as in Example 1 using the $3ZnO.ZnAl_2O_4$ particles coated with the surface treating agent.

EXAMPLES 3, 4

An elastic polyurethane fiber was produced in the same manner as in Example 1 except that $2ZnO.ZnAl_2O_4$ obtained by firing $Zn_3Al_2.(OH)_{10}(CO_3).2H_2O$ at 900° C. and $7ZnO.ZnAl_2O_4$ obtained by firing $Zn_8Al_2(OH)_{20}(CO_3).7H_2O$ at 900° C. were used in place of 3 $ZnO.ZnAl_2O_4$ in Example 1.

EXAMPLE 5

An elastic polyurethane fiber was produced in the same manner as in Example 1 except that 3 $ZnO.ZnAl_2O_4$ obtained by firing at 1,150° C. was used in place of $3ZnO.ZnAl_2O_4$ in Example 1.

EXAMPLE 6

An elastic polyurethane fiber was produced in the same manner as in Example 1 except that a product ((Zn, Al)O solid solution) obtained by firing $Zn_4Al_2(OH)_{12}(CO_3).3H_2O$ at 500° C. was used in place of $3ZnO.ZnAl_2O_4$ produced by firing at 900° C. in Example 1.

EXAMPLES 7, 8

An elastic polyurethane fiber was produced in the same manner as in Example 1 except that $3MgO.MgAl_2O_4$ obtained by firing $Mg_4Al_2(OH)_{12}(CO_3).3H_2O$ at 900° C. and (Mg, Zn, Al)O solid solution obtained by firing $Mg_5Al_2(OH)_{16}(CO_3).5H_2O$ at 450° C were used in place of $3ZnO.ZnAl_2O_4$ in Example 1.

COMPARATIVE EXAMPLE 1

An elastic polyurethane fiber was produced in the same manner as in Example 1 except that $13ZnO.ZnAl_2O_4$ obtained by firing $Zn_{14}Al_2(OH)_{32}(CO_3).13H_2O$ at 1,400° C. was used in place of $3ZnO.ZnAl_2O_4$ in Example 1.

COMPARATIVE EXAMPLE 2

An elastic polyurethane fiber was produced in the same manner as in Example 1 except that $0.4ZnO.ZnAl_2O_4$ obtained by firing $Zn_{1.4}Al_2(OH)_{6.8}(CO_3).0.4H_2O$ at 900° C. was used in place of $3ZnO.ZnAl_2O_4$ in Example 1.

COMPARATIVE EXAMPLE 3

An elastic polyurethane fiber was produced in the same manner as in Example 1 except that $Zn_4Al_2(OH)_{12}(CO_3).3H_2O$ (hydrotalcite) the particles the surface of which had been coated with 1% by weight of stearic acid by the same procedure as in Example 2 was used in place of $3ZnO.ZnAl_2O_4$ in Example 1.

COMPARATIVE EXAMPLES 4 TO 6

An elastic polyurethane fiber was produced in the same manner as in Example 1 except that zinc oxide (commercially available, having a high purity of at 99.7% or more and an average particle size of 1 $\mu$m or less) or a solid solution of magnesium oxide and zinc oxide (magnesium oxide/zinc oxide ratio of 65/35) was used in place of $3ZnO.ZnAl_2O_4$ in Example 1. An elastic polyurethane fiber was produced in the same manner as in Example 1 except that $3ZnO.ZnAl_2O_4$ was not added.

Tables 1, 2 show the evaluation results of the chlorine resistance, filter clogging of the polyurethane spinning dope and the spinning stability of each of the elastic polyurethane fibers obtained in Examples 1 to 8 and Comparative Examples 1 to 6.

EXAMPLE 9

A 2-way tricot fabric was prepared from the elastic polyurethane fiber obtained in Example 1, and its chlorine resistance in a swimming pool was tested.

COMPARATIVE EXAMPLE 7

A 2-way tricot fabric was prepared from the elastic polyurethane fiber obtained in Comparative Example 4, and its chlorine resistance in a swimming pool was tested.

Tables 3, 4 show amounts of the anti-chlorine agent retaining in the 2-way tricot fabrics in Example 9 and Comparative Example 7 prior to and subsequent to dyeing, and the results of evaluating the chlorine resistance of the fabrics.

TABLE 1

| | Anti-chlorine agent | | | Molar | Addn. |
|---|---|---|---|---|---|
| | Hydrotalcite compound (Before firing) | Firing temp. (° C.) | Composite oxide obtained by firing hydro-talcite cpd. (after firing) | ratio of bi-valent metal $M^{2+}$ to Al | amt. based on poly-thane (wt. %) |
| Ex. 1 | $Zn_4Al_2(OH)_{12}(CO_3).3H_2O$ | 900 | $3ZnO.ZnAl_2O_4$ | 2.0 | 4.0 |
| Ex. 2 | $Zn_4Al_2(OH)_{12}(CO_3).3H_2O$ | 900 | $3ZnO.ZnAl_2O_4$ | 2.0 | 4.0 |
| Ex. 3 | $Zn_3Al_2(OH)_{10}(CO_3).2H_2O$ | 900 | $2ZnO.ZnAl_2O_4$ | 1.5 | 4.0 |
| Ex. 4 | $Zn_8Al_2(OH)_{20}(CO_3).7H_2O$ | 900 | $7ZnO.ZnAl_2O_4$ | 4.0 | 4.0 |
| Ex. 5 | $Zn_4Al_2(OH)_{12}(CO_3).3H_2O$ | 1150 | $3ZnO.ZnAl_2O_4$ | 2.0 | 4.0 |
| Ex. 6 | $Zn_4Al_2(OH)_{12}(CO_3).3H_2O$ | 500 | (Zn,Al)O solid solution | 2.0 | 4.0 |
| Ex. 7 | $Mg_4Al_2(OH)_{12}(CO_3).3H_2O$ | 900 | $3Mgo.MgAl_2O_4$ | 2.0 | 4.0 |
| Ex. 8 | $Mg_5ZnAl_2(OH)_{16}(CO_3).5H_2O$ | 450 | (Mg,Zn, Al)O solid solution | 3.0 | 4.0 |
| C. Ex. 1* | $Zn_{14}Al_2(OH)_{32}(CO_3).13H_2O$ | 1400 | $13ZnO.ZnAl_2O_4$ | 7.0 | 4.0 |
| C. Ex. 2 | $Zn_{1.4}Al_2(OH)_{6.8}(CO_3).0.4H_2O$ | 900 | $0.4ZnO.ZnAl_2O_4$ | 0.7 | 4.0 |
| C. Ex. 3 | $Zn_4Al_2(OH)_{12}(CO_3).3H_2O$ (surface treated with 1 wt. % of stearic acid) | | | 2.0 | 4.0 |
| C. Ex. 4 | ZnO | | | — | 4.0 |
| C. Ex. 5 | MgO/ZnO solid solution (MgO/ZnO = 65/35) | | | — | 4.0 |
| C. Ex. 6 | without agent | | | — | 0 |

Note:
#Surface treated with 1 wt. % of stearic acid
*C. Ex. = Comparative Example

TABLE 2

| | Filter clogging caused by spinning dope $\Delta P$ (kg/cm$^2$) | Spinning stability Limit denier per single filament (d) | Chlorine resistance tested by immersion in 3 ppm chlorine water after dyeing and treating with tannin $\tau_{1/2}$(Hr) |
|---|---|---|---|
| Ex. 1 | 0.6 | 1.4 | 106 |
| Ex. 2 | 0.4 | 1.2 | 136 |
| Ex. 3 | 0.5 | 1.3 | 85 |
| Ex. 4 | 0.7 | 1.6 | 124 |
| Ex. 5 | 1.3 | 1.7 | 102 |
| Ex. 6 | 0.9 | 1.8 | 103 |
| Ex. 7 | 1.1 | 1.8 | 87 |
| Ex. 8 | 1.8 | 1.9 | 91 |
| Comp. Ex. 1 | 10.2 | Frequent yarn breakage took place. | |

TABLE 2-continued

| | Filter clogging caused by spinning dope ΔP (kg/cm$^2$) | Spinning stability Limit denier per single filament (d) | Chlorine resistance tested by immersion in 3 ppm chlorine water after dyeing and treating with tannin $\tau_{1/2}$(Hr) |
|---|---|---|---|
| | | Continuity of spinning was impossible | |
| Comp. Ex. 2 | 0.9 | 1.3 | 51 |
| Comp. Ex. 3 | 2.0 | 2.2 | 67 |
| Comp. Ex. 4 | 2.5 | 2.4 | 59 |
| Comp. Ex. 5 | 6.4 | 2.6 | 52 |
| Comp. Ex. 6 | 0.2 | 1.2 | 28 |

TABLE 3

| | Anti-chlorine agent | | | Molar | Addn. |
|---|---|---|---|---|---|
| | Hydrotalcite compound (Before firing) | Firing temp. (° C.) | Composite oxide obtained by firing hydro-talcite cpd. (after firing) | ratio of bi-valent metal $M^{2+}$ to Al | amt. based on poly-thane (wt. %) |
| Ex. 9 | $Zn_4Al_2(OH)_{12}(CO_3)$. $3H_2O$ | 900 | 3ZnO. $ZnAl_2O_4$ | 2 | 4.0 |
| Comp. Ex. 7 | ZnO | | | — | 4.0 |

TABLE 4

| | Amount of anti-chlorine agent in 2-way tricot fabric (wt. % based on polyurethane solid component) | | | Chlorine resistance of 2-way tricot fabric Number of days required until formation of defect |
|---|---|---|---|---|
| | Gray fabric | After treatment at pH 5 | Retention area (%) | was observed. (days) |
| Ex. 9 | 4.0 | 3.8 | 93 | 41 |
| Comp. Ex. 7 | 4.0 | 1.3 | 33 | 26 |

INDUSTRIAL APPLICABILITY

The elastic polyurethane fiber of the present invention has excellent durability to chlorine-induced deterioration, and exhibits extremely reduced degree of swelling in chlorine water. The dyeing of the present polyurethane show little discoloration even after dye-fixation treatment by tannin solution is applied. The elastic polyurethane fiber of the present invention is therefore extremely appropriate for swimwear to be repeatedly used in a pool containing chlorine over a long period of time.

The polyurethane spinning dope containing a composite oxide in the present invention extremely seldom causes filter clogging or shows yarn breakage, and stabilized spinning can be conducted over a long period of time.

What is claimed is:

1. An elastic polyurethane fiber comprising, based on the polyurethane, 0.5 to 10% by weight of composite oxide particles obtained by firing at temperatures of 300 to 1200° C. a composite compound which comprises bivalent metal $M^{2+}$, wherein $M^{2+}$ is at least one metal selected from the group consisting of Zn and Mg, and Al, and in which the molecular ratio of the bivalent metal $M^{2+}$ to Al is from 1/1 to 5/1.

2. The elastic polyurethane fiber according to claim 1, wherein the bivalent metal $M^{2+}$ is Zn.

3. An elastic polyurethane fiber comprising, based on the polyurethane, 0.5 to 10% by weight of composite oxide particles obtained by firing at temperatures form 700 to 1,200° C. a composite compound which comprises Zn and Al and in which the molecular ratio of Zn to Al is from 1/1 to 5/1.

4. The elastic polyurethane fiber according to claim 1, wherein at least one substance selected from the group consisting of fatty acids, phosphoric esters, styrene/maleic anhydride copolymers and esterified products of styrene/maleic anhydride copolymers is allowed to adhere to the surface of at least a part of the composite oxide.

5. The elastic polyurethane fiber according to claim 1, wherein the content of the composite oxide particles is from 2 to 8% by weight.

6. The elastic polyurethane fiber according to claim 1, wherein the average particle size is 5 μm or less.

7. The elastic polyurethane fiber according to claim 6, wherein the average particle size is 1 μm or less.

* * * * *